US008237758B2

(12) United States Patent
Taguchi et al.

(10) Patent No.: US 8,237,758 B2
(45) Date of Patent: Aug. 7, 2012

(54) IMAGE ERASING APPARATUS

(75) Inventors: Hiroyuki Taguchi, Shizuoka-ken (JP); Ken Iguchi, Shizuoka-ken (JP); Minoru Yoshida, Tokyo (JP); Osamu Takagi, Tokyo (JP); Takahito Kabai, Shizuoka-ken (JP); Yoshiaki Kaneko, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 363 days.

(21) Appl. No.: 12/701,081

(22) Filed: Feb. 5, 2010

(65) Prior Publication Data

US 2010/0194839 A1 Aug. 5, 2010

Related U.S. Application Data

(60) Provisional application No. 61/150,264, filed on Feb. 5, 2009.

(51) Int. Cl.
*B41J 29/16* (2006.01)

(52) U.S. Cl. ..... 347/179

(58) Field of Classification Search ..... 347/179, 347/171–174, 131, 223, 229, 233, 234, 243, 347/104, 105; 399/4, 187, 188; 250/316.1, 250/317.1

See application file for complete search history.

(56) References Cited

U.S. PATENT DOCUMENTS

| | | | | |
|---|---|---|---|---|
| 4,661,703 | A * | 4/1987 | Ishikawa et al. | 250/317.1 |
| 4,709,149 | A * | 11/1987 | Takahashi et al. | 250/317.1 |
| 5,333,039 | A * | 7/1994 | Sagara | 347/131 |
| 7,324,237 | B2 * | 1/2008 | Okada | 347/179 |
| 2007/0285491 | A1 * | 12/2007 | Kishimoto | 347/233 |

FOREIGN PATENT DOCUMENTS

JP 2001-51555 A 2/2001

* cited by examiner

*Primary Examiner* — Kristal Feggins
(74) *Attorney, Agent, or Firm* — Patterson & Sheridan, LLP

(57) ABSTRACT

An image erasing apparatus includes: a scanner which detects a side of a sheet on which an image is formed using a thermally decolorable coloring agent; a heat roller which provides heat for the sheet having the image formed thereon; and a controller which causes a quantity of heat provided for the sheet from the heat roller when an image forming side detected by the scanner does not face the heat roller to be greater than a quantity of heat provided for the sheet from the heat roller when the image forming side faces the heat roller.

20 Claims, 12 Drawing Sheets

IMAGE ERASING APPARATUS

CROSS-REFERENCE TO RELATED APPLICATION

This application is based upon and claims the benefit of priority from: U.S. provisional application 61/150,264, filed on Feb. 5, 2009 the entire contents of each of which are incorporated herein by reference.

TECHNICAL FIELD

The present invention relates to a technique of heating a coloring agent adhering to a sheet and thereby erasing an image formed by the coloring agent.

BACKGROUND

A technique of heating a sheet having an ink adhering thereto and thereby decolorizing the ink adhering to the sheet is proposed. For decolorizing the ink, a dedicated device is used to heat the sheet. Specifically, plural sheets are stacked in the dedicated device and the plural sheets are heated in the state of being nipped by the device.

If plural sheets are superimposed and then heated, heat cannot be efficiently transmitted to the ink on each sheet. That is, if heat is to be transmitted to plural sheets which are superimposed on each other, heat is transmitted most quickly to the sheet situated at the edge in the sheet stacking direction and heat is transmitted most slowly to the sheet situated in the middle.

Such heat transmission may cause more than necessary heat to be transmitted to a specific sheet and heat energy is wastefully consumed.

SUMMARY

According to an aspect of the invention, an image erasing apparatus includes: a scanner which detects a side of a sheet on which an image is formed using a thermally decolorable coloring agent; a heat roller which provides heat for the sheet having the image formed thereon; and a controller which causes a quantity of heat provided for the sheet from the heat roller when an image forming side detected by the scanner does not face the heat roller to be greater than a quantity of heat provided for the sheet from the heat roller when the image forming side faces the heat roller.

According to another aspect of the invention, an image erasing apparatus includes: a scanner which detects a side of a sheet on which an image is formed using a thermally decolorable coloring agent; a heat roller which provides heat for the sheet having the image formed thereon; a reverse mechanism which reverses the sheet; and a controller which causes the sheet to move toward the heat roller and thus causes heating to be carried out when an image forming side detected by the scanner faces the heat roller, and causes the reverse mechanism to reverse the sheet and then causes the heat roller to carry out heating on the reversed sheet when the image forming side does not face the heat roller.

DETAILED DESCRIPTION

Hereinafter, embodiments of the invention will be described with reference to the drawings.

First Embodiment

Figure 1:
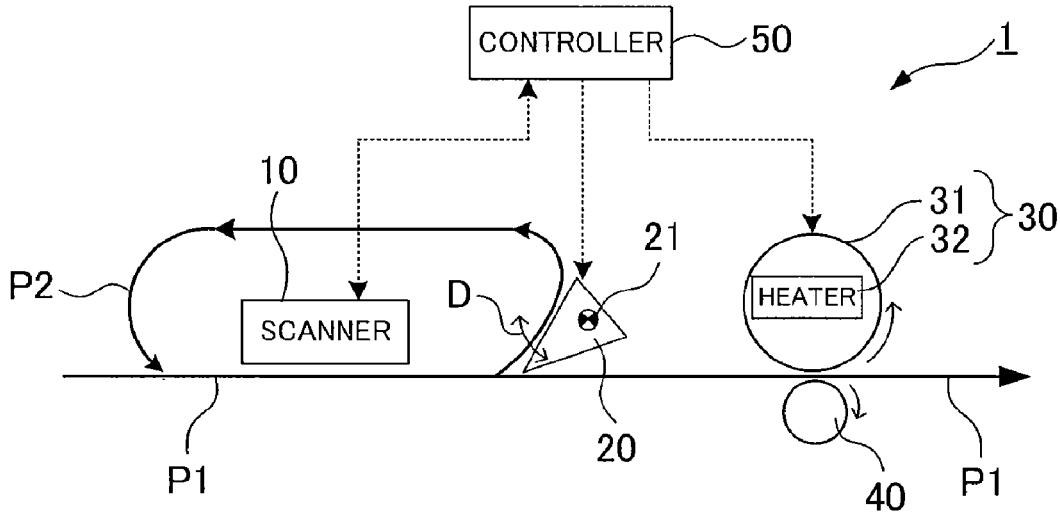
FIG. 1 is a schematic view showing the configuration of a part of an image erasing apparatus as a first embodiment of the invention.

An image erasing apparatus as a first embodiment of the invention will be described. First, the configuration of a part of the image erasing apparatus according to this embodiment will be described with reference to FIG. 1.

An image erasing apparatus 1 has a sheet carrying path P1 for carrying a sheet. A scanner 10, a flapper 20 and a heat roller 30 are arranged along the sheet carrying path P1. Plural carrying rollers (not shown) are arranged in the sheet carrying path P1. The plural carrying rollers move a sheet along the sheet carrying path P1.

The scanner 10 is fixed at a predetermined position on the sheet carrying path P1. The scanner 10 emits detection light to a sheet that moves on the sheet carrying path P1, and also receives the detection light reflected from the sheet. By the (scanning) operation of the scanner 10, image data corresponding to an image on the sheet is generated.

The data generated by the scanner 10 is transmitted to a controller 50. The controller 50 outputs a control signal to the scanner 10 and thus controls the operation of the scanner 10.

The flapper 20 is arranged downstream of the scanner 10 on the sheet carrying path P1. The flapper 20 swings in the direction of arrow D about an axis 21. That is, the flapper 20 swings between a first position and a second position. The flapper 20 is driven by an actuator (not shown) and the controller 50 controls the driving by the actuator. Thus, the controller 50 can move the flapper 20 between the first position and the second position.

When the flapper 20 is at the first position, the sheet passed through the scanner 10 moves along the sheet carrying path P1 and is guided to the heat roller 30. When the flapper 20 is at the second position, the sheet passed through the scanner 10 is guided to a reverse path P2.

On the reverse path P2, the sheet is reversed and then returned to the sheet carrying path P1. The sheet passed through the reverse path P2 is returned upstream of the scanner 10 on the sheet carrying path P1. Therefore, the sheet passed through the reverse path P2 passes the scanner 10 again.

The heat roller 30 is arranged downstream of the flapper 20 on the sheet carrying path P1. The heat roller 30 is arranged on the same side of the sheet carrying path P1 as where the scanner 10 is arranged. That is, the side of the sheet scanned by the scanner 10 contacts the heat roller 30.

The heat roller 30 has a roller 31 and a heater 32 arranged inside the roller 31. The rotation state of the roller 31 and the driving of the heater 32 are controlled by the controller 50. The rotation state of the roller 31 includes rotation and stop of the roller 31 and the rotating speed of the roller 31. The heater 32 generates heat by being electrified and can properly employ a known configuration. The controller 50 controls the electrification of the heater 32.

At a position facing the heat roller 30 across the sheet carrying path P1, a press roller 40 is arranged. The press roller 40 causes the sheet to tightly contact the outer circumferential surface of the heat roller 30. Thus, heat generated by the heater 32 is transmitted to the sheet that contacts the outer circumferential surface of the roller 31.

The sheet passed through the heat roller 30 is discharged to a paper discharge tray (not shown) and is reused as a sheet for image formation.

In this embodiment, an ink or toner as a coloring agent (hereinafter simply referred to as ink) is adhering to at least one side of the sheet carried on the sheet carrying path P1, and an image is formed thereon. The ink used in this embodiment decolorizes when the ink is heated. The components of the decolorable ink are known and therefore will not be described further in detail.

In the image erasing apparatus 1 according to this embodiment, the sheet having the ink adhering thereto is heated by using the heat roller 30 and the ink can be thus decolorized. That is, the image formed by the ink can be erased.

The image erasing apparatus 1 can be configured as a dedicated apparatus for erasing an image. Moreover, the operation of the image erasing apparatus 1 can be carried out using members arranged in an image processing apparatus (e.g. multi-function peripheral (MFP)). For example, a sheet carrying path for duplex print is used as the reverse path P2 and a fixing device can be used as the heat roller 30 and the press roller 40.

Figure 2:
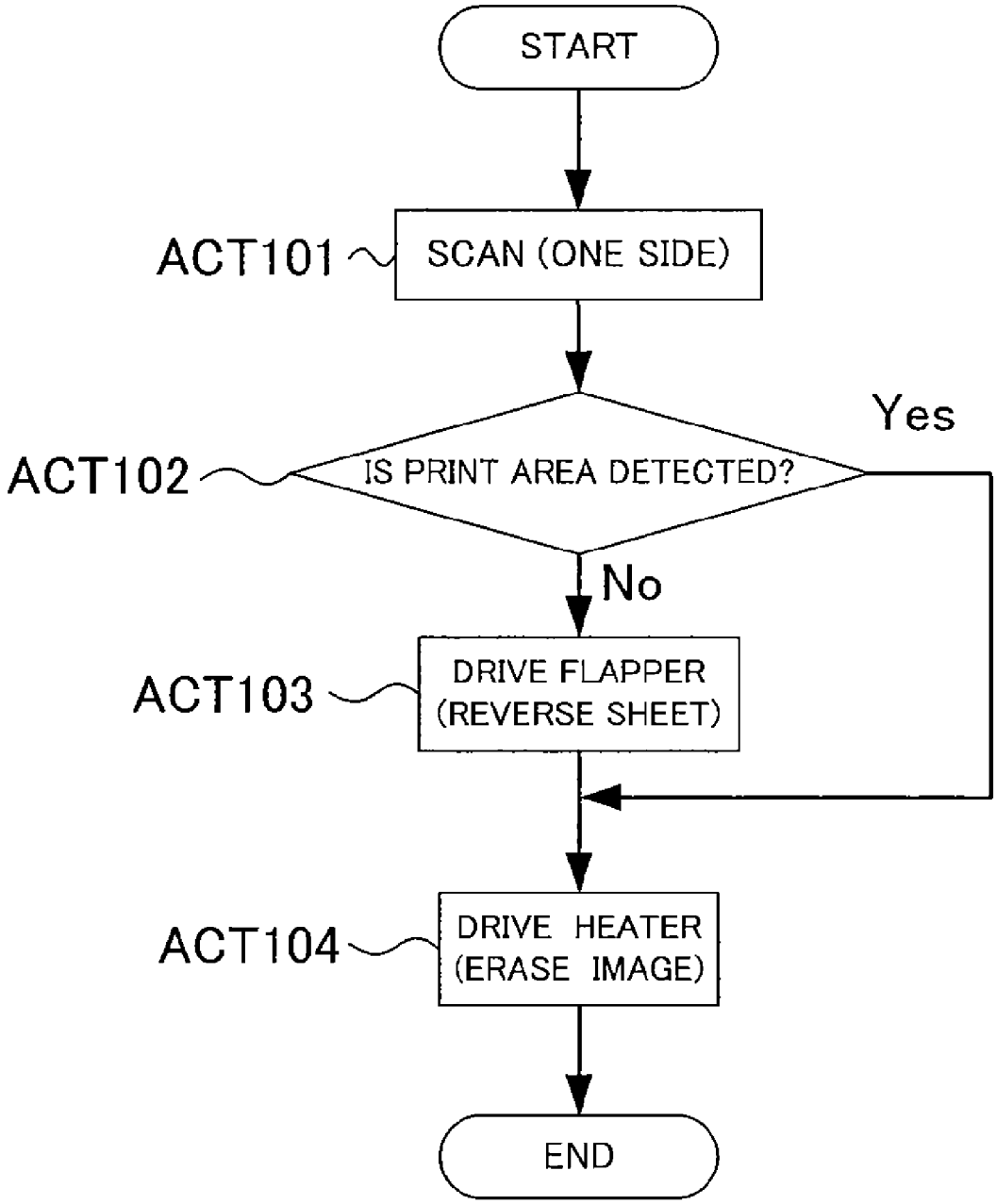
FIG. 2 is a flowchart showing the operation of the image erasing apparatus as the first embodiment.

Next, the operation of the image erasing apparatus 1 according to this embodiment will be described with reference to the flowchart shown in FIG. 2. The processing shown in FIG. 2 is executed by the controller 50. When the image erasing apparatus 1 is in an initial state, the flapper 20 is situated at the first position and the sheet moves along the sheet carrying path P1. In the processing shown in FIG. 2, a case of handling a sheet having an image formed on one side will be described.

The controller 50 drives the scanner 10 in timing when the sheet reaches the scanning position of the scanner 10 (ACT 101). The scanner 10 scans the sheet moving along the sheet carrying path P1. Here, if the image is formed on the side of the sheet that faces the scanner 10, the image is scanned by this scanning. The data scanned by the scanner 10 is sent to the controller 50. The controller 50 determines whether the sheet has a print area or not (ACT 102). A print area refers to an area where an image is formed.

If it is determined that the sheet has a print area (Yes in ACT 102), the processing shifts to ACT 104. If it is determined that the sheet has no print area (No in ACT 102), the controller 50 moves the flapper 20 from the first position to the second position (ACT 103).

As the flapper 20 is moved to the second position, the sheet passed through the scanner 10 is guided to the reverse path P2 by the flapper 20. After the sheet is moved to the reverse path P2, the controller 50 returns the flapper 20 from the second position to the first position. The sheet, returned from the reverse path P2 to the sheet carrying path P1, passes the scanner 10 and is carried to the heat roller 30. The sheet passed through the reverse path P2 has the print area formed on the side that contacts the heat roller 30.

When the sheet from the reverse path P2 passes the scanner 10, the scanner 10 can scan the sheet. Alternatively, scanning can be omitted on the assumption that the reversed sheet already had an image formed thereon.

The controller 50 drives the heater 32 (ACT 104). Thus, the sheet guided to the heat roller 30 is heated and the print area (image) formed on the sheet is erased by the heating. When the heating by the heat roller 30 is carried out, the print area on the sheet faces the outer circumferential surface of the heat roller 30.

According to this embodiment, heating can be carried out in the state where the side having the print area formed thereon is in contact with the outer circumferential surface of the heat roller 30. Therefore, the print area (the ink forming the image) can be efficiently heated.

Also, in this embodiment, the print area formed on the sheet can be erased simply by the passage through the sheet carrying path P1 of the sheet. The erasure of an image can be continuously carried out on plural sheets.

In the processing shown in FIG. 2, a sheet having a print image formed on one side is used. However, in the case of using a sheet having a print area formed on both sides, the following processing can be carried out.

Information indicating duplex print (information about duplex print) can be added to a print area on the sheet. Thus, when the scanner 10 scans the print area, the information about duplex print can be acquired and it can be determined whether the print is duplex print or single-side print.

The information about duplex print can be formed on one side or both sides of the sheet. However, it is preferable that the information about duplex print is formed on both sides. Thus, whichever side of the sheet is scanned by the scanner 10, the information about duplex print can be acquired.

The information about duplex print can also be formed in a different area from the area where the original image is formed, or can be combined with the original image.

When the sheet has duplex print, the quantity of heat provided for the sheet can be made greater than the quantity of heat given when the sheet has single-side print. Thus, the print areas (images) formed on both sides of the sheet can be erased by one-time heating.

For example, the temperature of the heater 32 when the sheet is duplex-printed can be made higher than the temperature of the heater 32 when the sheet is single-side-printed. In other words, the controller 50 can change the temperature of the heater 32 in accordance with single-side print and duplex print.

The control by the controller 50 enables the carrying speed of the sheet while carrying out the heating to be changed in accordance with single-side print and duplex print. Specifically, the carrying speed of the duplex-printed sheet can be made lower than the carrying speed of the single-side-printed sheet. To control the sheet carrying speed during the heating, the rotating speed of the heat roller 30 can be controlled.

Meanwhile, information indicating the use of an ink that decolorizes by heating can be added to the print area on the sheet. Thus, when the print area is scanned, it can be determined whether a decolorable ink is used or not. If a decolorable ink is used, as described in this embodiment, the image can be erased by the heating. If a decolorable ink is not used, the heating can be omitted.

In this embodiment, the scanner 10 and the heat roller 30 are arranged on the same side of the sheet carrying path P1. The scanner 10 and the heat roller 30 can also be arranged at positions on the opposite sides across the sheet carrying path P1. In such case, the side of the sheet that is scanned by the scanner 10 does not face the heat roller 30. Therefore, when carrying the sheet to the heat roller 30, it is necessary to control the driving of the flapper 20 so that the print area faces the heat roller 30.

Meanwhile, in the case of heating the print area, the print rate within the print area can be calculated on the basis of the data acquired from the scanner 10 and the heating temperature and the sheet carrying speed can be changed in accordance with the print rate. The higher the print rate is, the more ink is used. Therefore, a greater quantity of heat is necessary to erase the image.

Thus, by controlling at least one of the heating temperature and the sheet carrying speed, it is possible to secure a necessary quantity of heat for erasing the image.

Specifically, the correspondence between the print rate and the heating temperature can be predetermined and a map showing the correspondence can be stored in a memory. For example, as the print rate increases, the heating temperature can be raised continuously or in a stepwise fashion.

Alternatively, the correspondence between the print rate and the carrying speed can be predetermined and a map showing the correspondence can be stored in a memory. Moreover, the relationship among the print rate, the heating temperature and the carrying speed can also be predetermined.

As a condition for changing the heating temperature or the carrying speed, other information about the sheet can be used as well as the print rate. This information includes, for example, the size, basis weight, and thickness of the sheet.

The greater the sheet size is, the greater quantity of heat is required. Therefore, the heating temperature and the carrying speed can be changed in accordance with the sheet size. The sheet size can be detected, for example, using a tray on which sheets are placed.

Also, the greater the basis weight or thickness of the sheet is, the greater quantity of heat is required. When heat of the heat roller 30 is transmitted to the side of the sheet opposite to the side in contact with the heat roller 30, the thermal conductivity changes in accordance with the basis weight or thickness of the sheet. Therefore, it is preferable to change the heating temperature and the carrying speed in accordance with the basis weight or thickness of the sheet. Particularly when erasing the images on the duplex-printed sheet by one-time heating, it is necessary to consider the basis weight and thickness of the sheet as described above.

The controller can acquire information about the thickness and basis weight of the sheet by receiving an operation input from the user. That is, the image erasing apparatus 1 can be provided with an input unit to input information about the thickness and basis weight of the sheet.

Meanwhile, though an entire single side of the sheet is scanned by the scanner 10 in this embodiment, it is also possible to scan a partial area of one side of the sheet. That is, it suffices that the formation of a print area on the sheet can be detected by using the scanner.

Second Embodiment

An image erasing apparatus as a second embodiment of the invention will be described with reference to FIG. 3. In this embodiment, members having the same functions as the members described in the first embodiment are denoted by the same reference numerals. Hereinafter, different features from the first embodiment will be mainly described.

In this embodiment, the flapper 20 is arranged downstream of the heat roller 30 on the sheet carrying path P1. The flapper 20 swings in the direction of arrow D and moves between a first position and a second position. When the flapper 20 is at the first position, the sheet from the heat roller 30 moves along the sheet carrying path P1. When the flapper 20 is at the second position, the sheet from the heat roller 30 moves the reverse path P2 and is guided upstream of the scanner 10 on the sheet carrying path P1.

Figure 4:
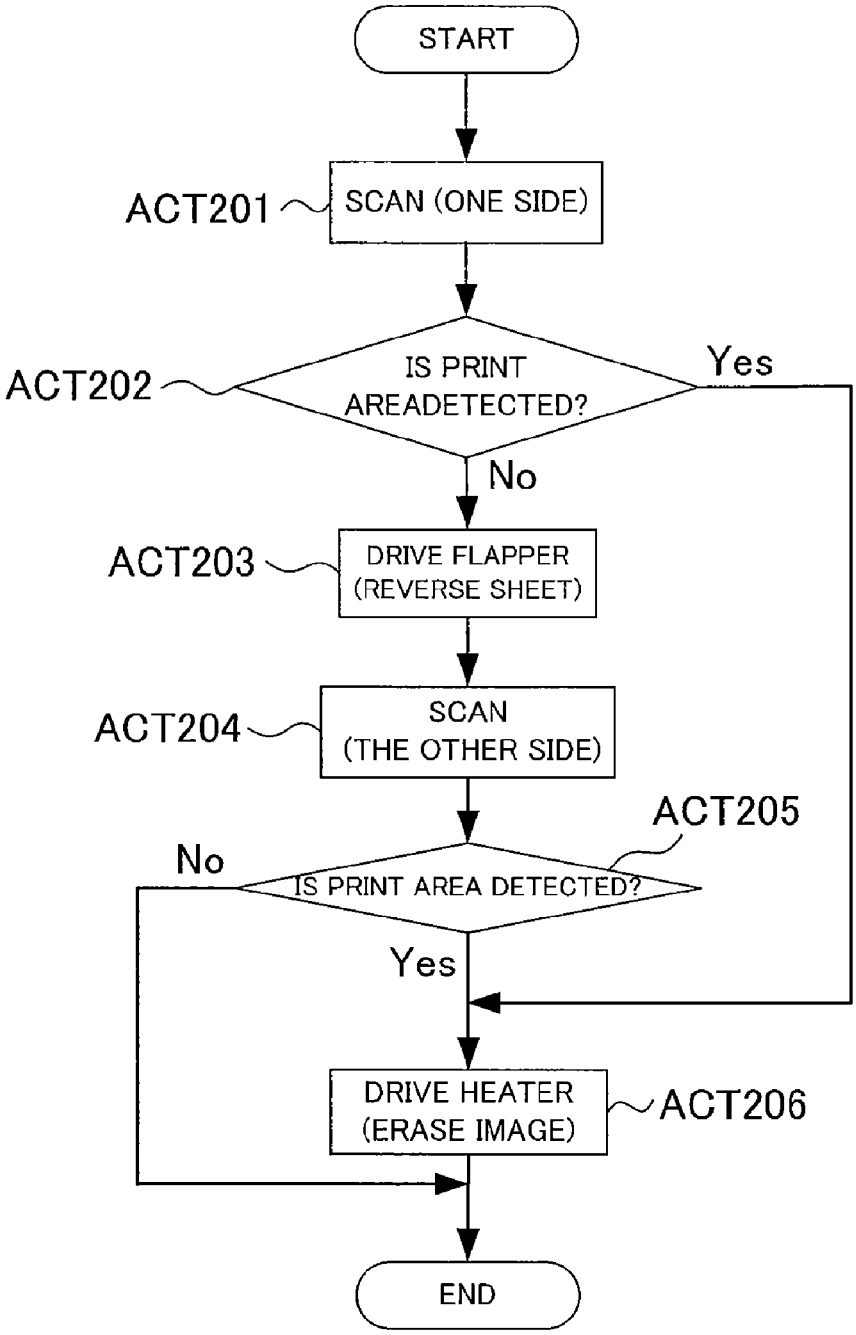
FIG. 4 is a flowchart showing the operation of the image erasing apparatus as the second embodiment.

Next, the operation of the image erasing apparatus 1 according to this embodiment will be described with reference to the flowchart shown in FIG. 4. The processing shown in FIG. 4 is executed by the controller 50. When the image erasing apparatus 1 is in an initial state, the flapper 20 is situated at the first position and the sheet moves along the sheet carrying path P1.

The controller 50 drives the scanner 10 in timing when the sheet reaches the scanning position of the scanner 10 (ACT 201). The scanner 10 scans the sheet moving along the sheet carrying path P1. Here, if the image is formed on the side of the sheet that faces the scanner 10, the image is scanned by this scanning. The data scanned by the scanner 10 is sent to the controller 50. The controller 50 determines whether the sheet has a print area or not (ACT 202).

If it is determined that the sheet has a print area (Yes in ACT 202), the processing shifts to ACT 206. If it is determined that the sheet has no print area (No in ACT 202), the controller 50 moves the flapper 20 from the first position to the second position (ACT 203).

The sheet passed through the scanner 10 passes the heat roller 30 and is guided to the reverse path P2 by the flapper 20. Here, since the heater 32 is not electrified, the sheet passed through the scanner 10 is not heated by the heat roller 30 and moves toward the reverse path P2. After the sheet is moved to the reverse path P2, the controller 50 returns the flapper 20 from the second position to the first position.

The sheet, moved from the reverse path P2 to the sheet carrying path P1, reaches the scanner 10 in the state where the sheet sides are reversed. The controller 50 drives the scanner 10 in timing when the sheet reaches the scanning position of the scanner 10 (ACT 204). The data scanned by the scanner 10 is sent to the controller 50. The controller 50 determines whether the sheet has a print area or not (ACT 205).

If the sheet has a print area (Yes in ACT 202, Yes in ACT 205), the controller 50 drives the heater 32 (ACT 206). Thus, the sheet passed through the scanner 10 is heated by the heat roller 30 and the print area formed on the sheet is erased by the heating. When the heating by the heat roller 30 is carried out, the print area on the sheet faces the outer circumferential surface of the heat roller 30.

According to the processing shown in FIG. 4, if a print area is formed on one side of the sheet, the side where the print area is formed can be made to contact the outer circumferential surface of the heat roller 30 and heat of the heat roller 30 can be efficiently provided for the print area.

Meanwhile, if a print area is formed on both sides of the sheet, for example, the following first or second processing method can be carried out.

As the first processing method, after heating is carried out on one side of the sheet, the sheet is guided to the reverse path P2 and then the other side is scanned. If a print area is formed on the other side, the heating by the heat roller 30 is carried out on the other side.

Since the sheet passed through the reverse path P2 and reaching the heat roller 30 receives the second heating, the quantity of heat provided for the sheet from the heat roller 30 can be reduced. For example, the electrification time of the heater 32 in the second heating can be made shorter than the electrification time of the heater 32 in the first heating. Also, the set temperature of the heater 32 in the second heating can be made lower than the set temperature of the heater 32 in the first heating.

If a print area is not formed on the other side, sheet can be moved along the sheet carrying path P1 without carrying out the heating by the heat roller 30.

As the second processing method, information indicating duplex print can be added to a print area on the sheet, as described also in the first embodiment. When the sheet is duplex-printed, the quantity of heat provided for the sheet can be made greater than the quantity of heat when the sheet is single-side-printed. Thus, the images formed both sides of the sheet can be erased by one-time heating.

Figure 3:
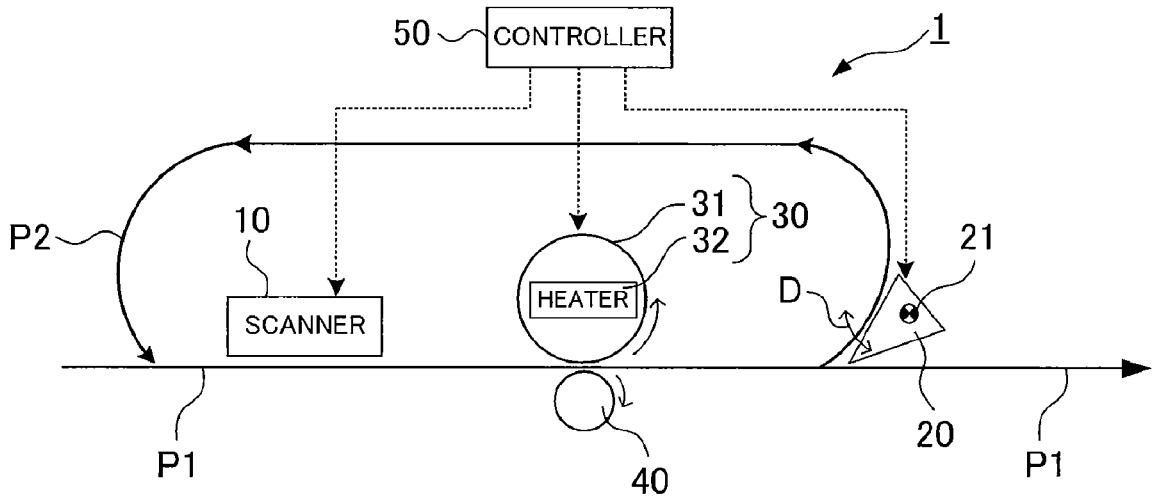
FIG. 3 is a schematic view showing the configuration of a part of an image erasing apparatus as a second embodiment of the invention.

In the reverse path P2 shown in FIG. 3, the sheet passed through the heat roller 30 is returned upstream of the scanner 10 on the sheet carrying path P1. However, a reverse path having other configurations can be used. For example, the sheet passed through the heat roller 30 can be returned between the scanner 10 and the heat roller 30 on the sheet carrying path P1. In such case, the reversed sheet does not pass the scanner 10 and is directly guided to the heat roller 30. The side of the sheet that does not face the scanner 10 contacts the heat roller 30 and receives the heating by the heat roller 30.

Meanwhile, as described in the first embodiment, the quantity of heat provided for the sheet can be varied in accordance with information about the sheet including print rate, sheet size, basis weight, and thickness.

Third Embodiment

An image erasing apparatus as a third embodiment of the invention will be described with reference to FIG. 5. In this embodiment, members having the same functions as the members described in the first embodiment are denoted by the same reference numerals. Hereinafter, different features from the first embodiment will be mainly described.

Figure 5:
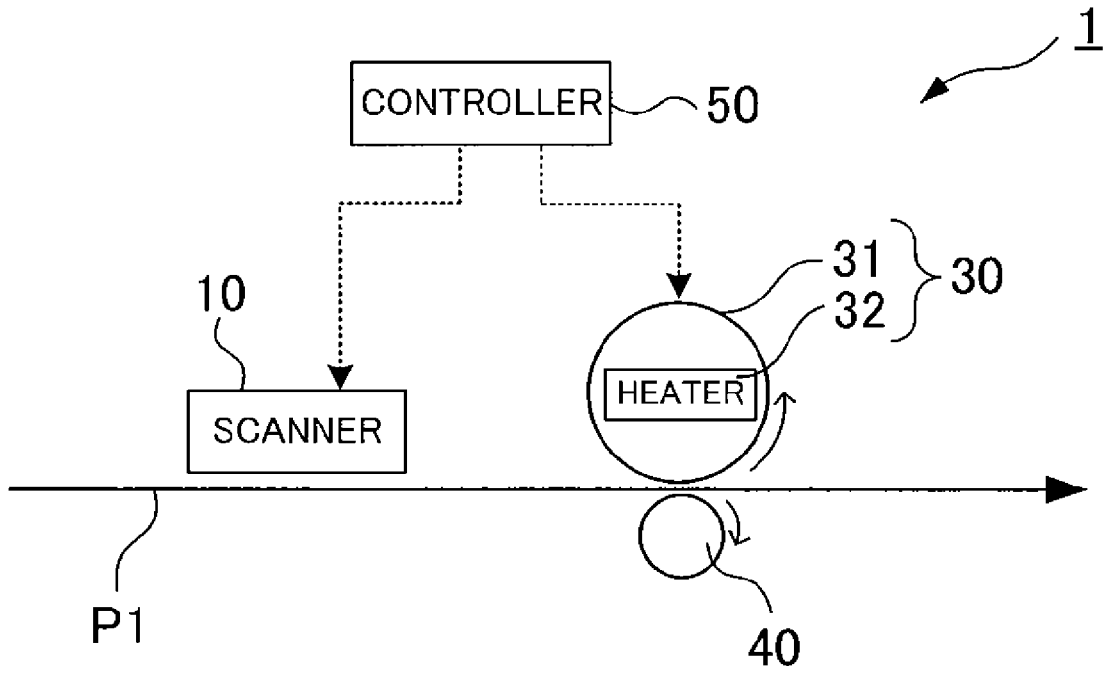
FIG. 5 is a schematic view showing the configuration of a part of an image erasing apparatus as a third embodiment of the invention.

As shown in FIG. 5, in the image erasing apparatus 1 of this embodiment, the reverse path P2 is omitted and the flapper 20 is not provided. Therefore, a sheet moves along the sheet carrying path P1, passes the scanner 10 and then passes the heat roller 30.

Figure 6:
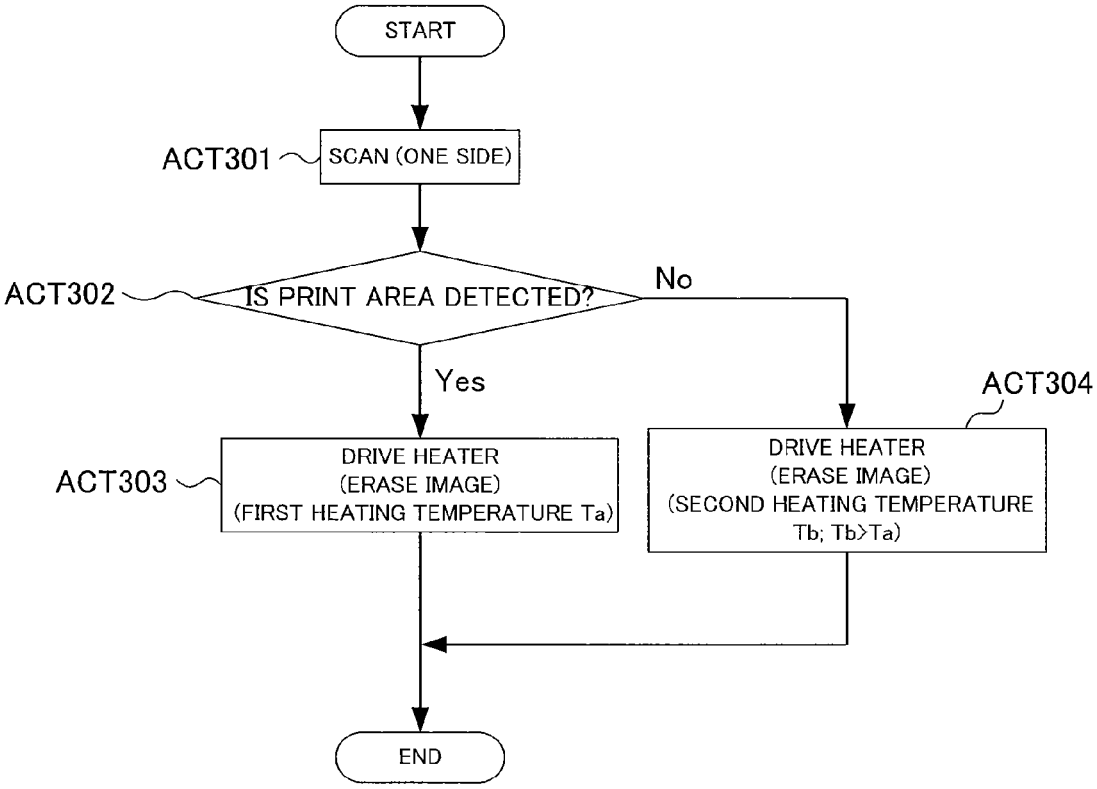
FIG. 6 is a flowchart showing the operation of the image erasing apparatus as the third embodiment.

Next, the operation of the image erasing apparatus 1 according to this embodiment will be described with reference to the flowchart shown in FIG. 6. The processing shown in FIG. 6 is executed by the controller 50. In the operation shown in FIG. 6, a sheet having a print area formed on one side is handled.

The controller 50 drives the scanner 10 in timing when the sheet reaches the scanning position of the scanner 10 (ACT 301). The scanner 10 scans the sheet moving along the sheet carrying path P1. That is, the scanner 10 scans the side of the sheet that faces the scanner 10.

The data scanned by the scanner 10 is sent to the controller 50. The controller 50 determines whether the sheet has a print area or not (ACT 302).

If a print area can be detected, the controller 50 determines that a print area is formed on the side of the sheet that faces the scanner 10, and then carries out processing of ACT 303. If no print area can be detected, the controller 50 determines that the side having a print area formed thereon does not face the scanner 10, and then carries out processing of ACT 304.

In the processing of ACT 303, the controller 50 drives the heater 32 and the heat roller 30 heats the sheet carried from the scanner 10. In the heating, the temperature of the heater 32 is set to a first heating temperature Ta.

In the processing of ACT 304, the controller 50 drives the heater 32 and the heat roller 30 heats the sheet carried from the scanner 10. In the heating, the temperature of the heater 32 is set to a second heating temperature Tb. The second heating temperature Tb is set at a higher value than the first heating temperature Ta. When the print area does not face the heat roller 30, the heating at the higher heating temperature Tb enables heat to reach the print area, thus erasing the print area.

In this embodiment, as the heating temperature is changed in accordance with whether the print area faces the outer circumferential surface (heating surface) of the heat roller 30 or not, heat energy at the time of erasing the image can be efficiently used. That is, by adjusting heat energy in the heating, it is possible to prevent wasteful consumption of heat energy.

In the processing shown in FIG. 6, a single-side-printed sheet is considered. However, in the case of considering a duplex-printed sheet as well, for example, the following processing method can be carried out.

As described in the first embodiment, information about duplex print can be added to a print area on the sheet. Thus, when the scanner 10 scans the print area, it can be determined whether the print is duplex print or single-side print. The information about duplex print can be formed on one side or both sides of the sheet. When the sheet is duplex-printed, the quantity of heat provided for the sheet can be made greater than the quantity of heat when the sheet is single-side-printed.

In the processing of ACT 303 and ACT 304, the temperature of the heater 32 is varied. However, it suffices to be able to vary the quantity of heat provided for the sheet, and other methods can also be used.

For example, in the processing of ACT 303 and ACT 304, the sheet carrying speed in the heating can be varied. Specifically, the sheet carrying speed when the print area does not face the heat roller 30 can be made lower than the sheet carrying speed when the print area faces the heat roller 30. Thus, the quantity of heat provided for the sheet can be varied without varying the temperature of the heater 32, and the print area can be efficiently erased.

Meanwhile, as described in the first embodiment, the quantity of heat provided for the sheet can be varied in accordance with information about the sheet including print rate, sheet size, basis weight, and thickness.

Fourth Embodiment

Figure 7:
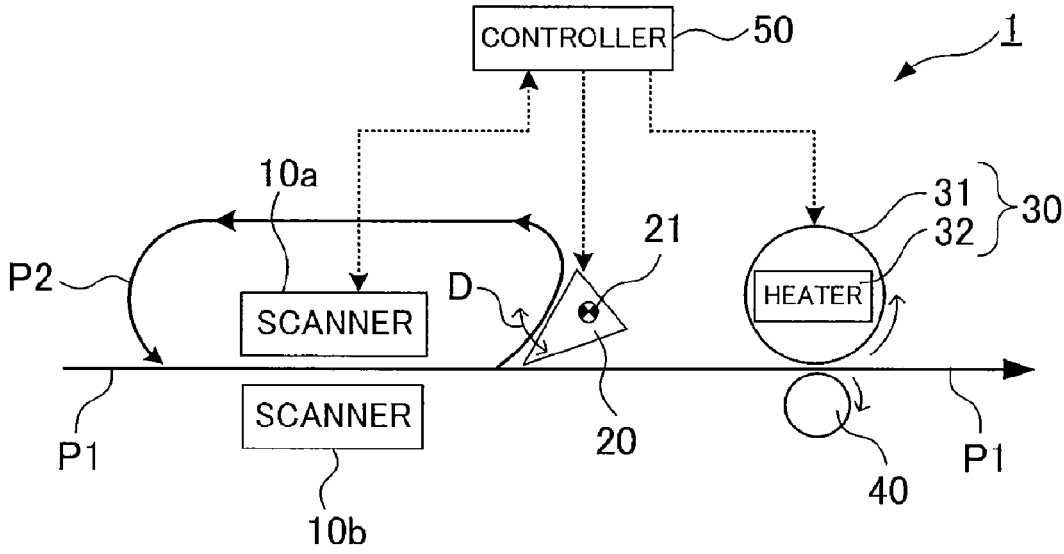
FIG. 7 is a schematic view showing the configuration of a part of an image erasing apparatus as a fourth embodiment of the invention.

An image erasing apparatus as a fourth embodiment of the invention will be described with reference to FIG. 7. In this embodiment, members having the same functions as the members described in the first embodiment are denoted by the same reference numerals. Hereinafter, different features from the first embodiment will be mainly described.

In the first embodiment (FIG. 1), the scanner 10 is arranged only on one side of the sheet carrying path P1, whereas in this embodiment, scanners 10*a* and 10*b* are arranged on both sides of the sheet carrying path P1. The scanner 10*a* is arranged on the side of the sheet carrying path P1 where the heat roller 30 is arranged. The scanner 10*b* is arranged at a position facing the scanner 10*a* across the sheet carrying path P1.

In this embodiment, the scanners 10*a* and 10*b* are arranged at the positions facing each other across the sheet carrying path P1. However, the scanners 10*a* and 10*b* need not face each other. That is, the scanners 10*a* and 10*b* can also be shifted from each other in a direction along the sheet carrying path P1.

Figure 8:
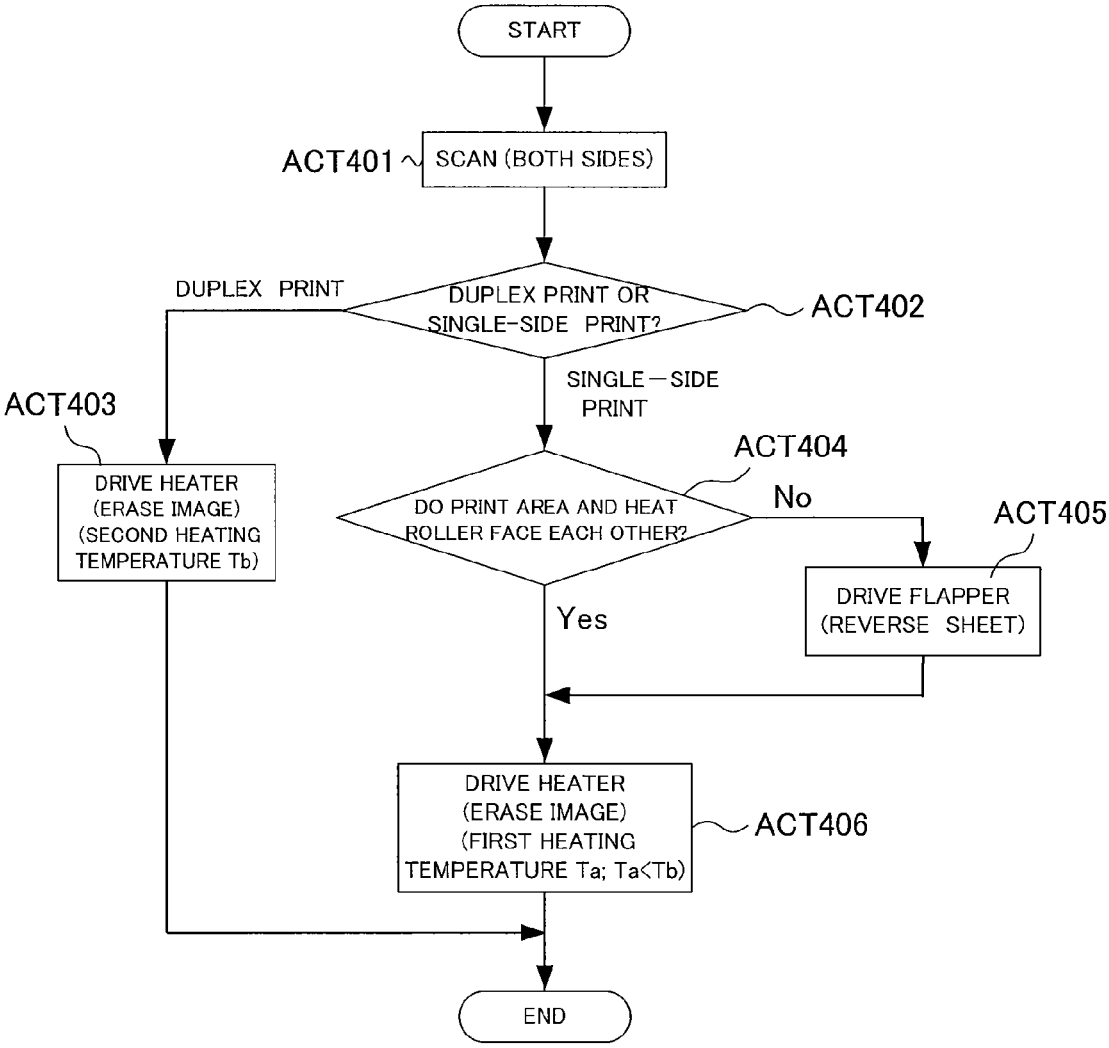
FIG. 8 is a flowchart showing the operation of the image erasing apparatus as the fourth embodiment.

Next, the operation of the image erasing apparatus 1 according to this embodiment will be described with reference to the flowchart shown in FIG. 8. The processing shown in FIG. 8 is executed by the controller 50. When the image erasing apparatus 1 is in an initial state, the flapper 20 is moved to the first position and the sheet passed through the scanners 10*a* and 10*b* move along the sheet carrying path P1 toward the heat roller 30.

The controller 50 drives the scanners 10*a* and 10*b* in timing when the sheet reaches the scanning positions of the scanners 10*a* and 10*b* (ACT 401). The scanners 10*a* and 10*b* scan the sheet moving along the sheet carrying path P1. The data scanned by the scanners 10*a* and 10*b* is sent to the controller 50. The controller 50 determines whether the sheet is duplex-printed or single-side-printed (ACT 402).

If the sheet is single-side-printed, the controller 50 can determine the side of the sheet where a print area is formed on the basis of the data from the scanners 10*a* and 10*b*. That is, the controller 50 can determine which of the scanners 10*a* and 10*b* is faced by the side where a print area is formed.

If the sheet is duplex-printed, the controller 50 drives the heater 32 (ACT 403). The heat roller 30 heats the sheet carried from the scanners 10*a* and 10*b*. In the heating, the temperature of the heater 32 is set to the second heating temperature Tb.

If the sheet is single-side-printed, the controller 50 determines whether the side where a print area is formed faces the heat roller 30 or not (ACT 404). As described above, the controller 50 can determine whether the print area faces the heat roller 30 or not on the basis of the output from the scanners 10*a* and 10*b*. That is, if the printed area is detected on the basis of the output from the scanner 10*a*, it means that the print area faces the heat roller 30. If the print area is detected on the basis of the output from the scanner 10*b*, it means that the print area does not face the heat roller 30.

If the print area does not face the heat roller 30 (No in ACT 404), the controller 50 moves the flapper 20 from the first position to the second position (ACT 405). Thus, the sheet passed through the scanners 10*a* and 10*b* is guided to the reverse path P2 and returns to the sheet carrying path P1 in the state where the sheet sides are reversed. That is, the side where the print area is formed faces the heat roller 30 now.

If the print area faces the heat roller 30 (Yes in ACT 404), the controller 50 drives the heater 32 (ACT 406). The temperature of the heater 32 is set to the first heating temperature Ta. The first heating temperature Ta is set at a lower value than the second heating temperature Tb.

According to this embodiment, as in the third embodiment, the print area (ink that forms the image) can be efficiently heated and wasteful consumption of heat energy in the heating can be prevented.

Meanwhile, as described in the first embodiment, the quantity of heat provided for the sheet can be varied in accordance with information about the sheet including print rate, sheet size, basis weight, and thickness.

Fifth Embodiment

Figure 9:
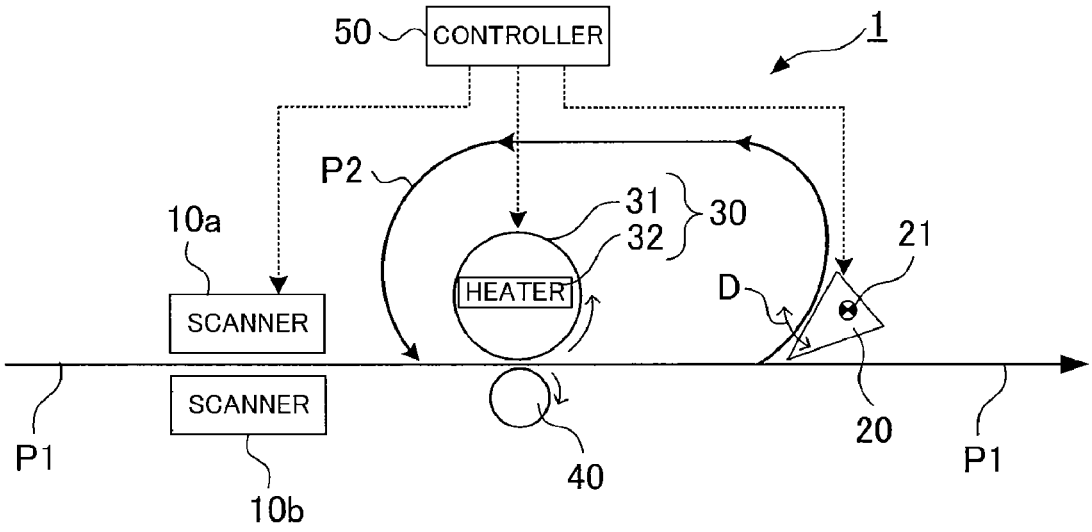
FIG. 9 is a schematic view showing the configuration of a part of an image erasing apparatus as a fifth embodiment of the invention.

An image erasing apparatus as a fifth embodiment of the invention will be described with reference to FIG. 9. In this embodiment, members having the same functions as the members described in the first and second embodiments are denoted by the same reference numerals. Hereinafter, different features from the second embodiment will be mainly described.

In the second embodiment (FIG. 3), the scanner 10 is arranged only on one side of the sheet carrying path P1. However, in this embodiment, scanners 10*a* and 10*b* are arranged on both sides of the sheet carrying path P1. The scanner 10*a* is arranged on the side of the sheet carrying path P1 where the heat roller 30 is arranged. The scanner 10*b* is arranged at a position facing the scanner 10*a* across the sheet carrying path P1.

Moreover, in this embodiment, the sheet moved to the reverse path P2 is returned between the scanners 10*a* and 10*b* and the heat roller 30, on the sheet carrying path P1.

Figure 10:
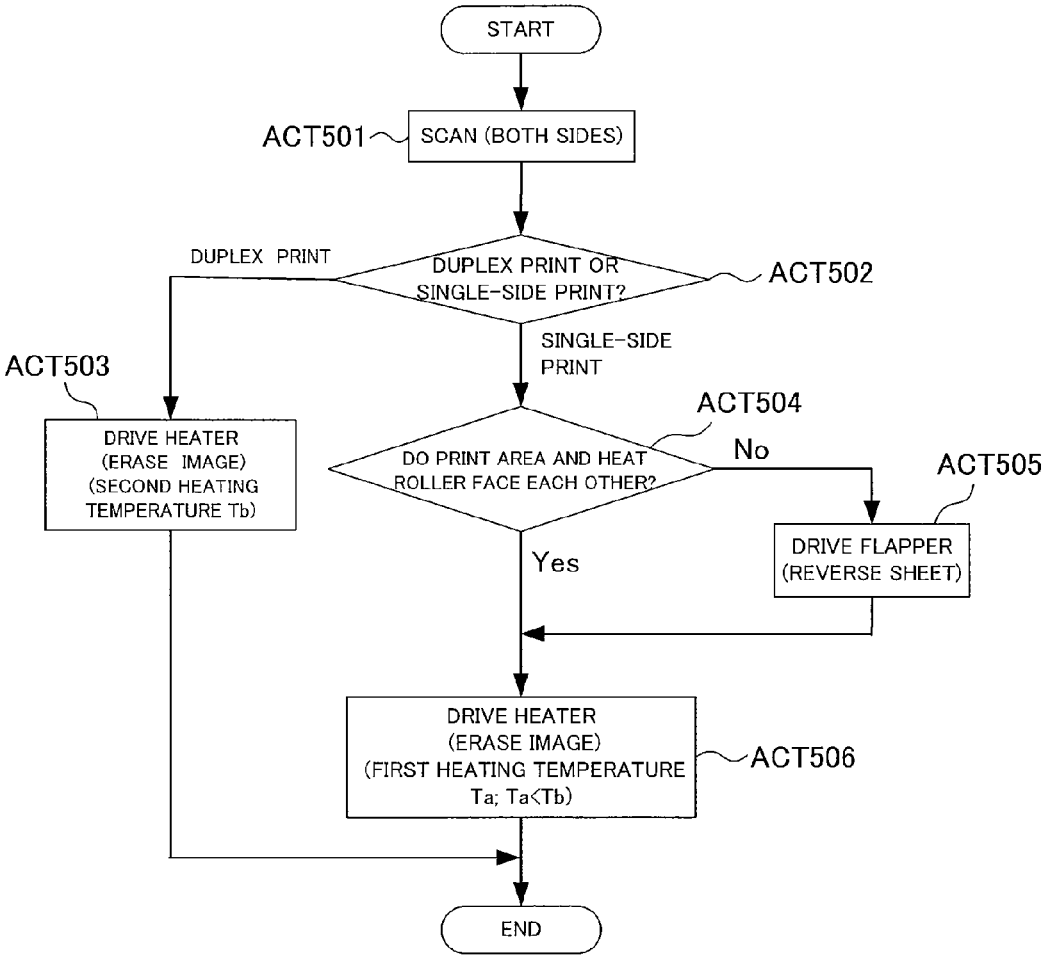
FIG. 10 is a flowchart showing the operation of the image erasing apparatus as the fifth embodiment.

Next, the operation of the image erasing apparatus 1 according to this embodiment will be described with reference to the flowchart shown in FIG. 10. The processing shown in FIG. 10 is executed by the controller 50. The processing of ACT 501 to ACT 506 shown in FIG. 10 correspond to the processing of ACT 401 to ACT 406 described with reference to FIG. 8, respectively.

If it is determined that the print area does not face the heat roller 30 in the processing of ACT 504, the sheet passes the heat roller 30 and is guided to the reverse path P2 by the flapper 20. When the sheet passes the heat roller 30, the heater 32 does not generate heat. When the sheet is returned from the reverse path P2 to the sheet carrying path P1, heating by the heat roller 30 is carried out on the sheet.

In this embodiment, too, the print area (ink) can be efficiently heated and wasteful consumption of heat energy in the heating can be prevented.

Meanwhile, as described in the first embodiment, the quantity of heat provided for the sheet can be varied in accordance with information about the sheet including print rate, sheet size, basis weight, and thickness.

Sixth Embodiment

Figure 11:
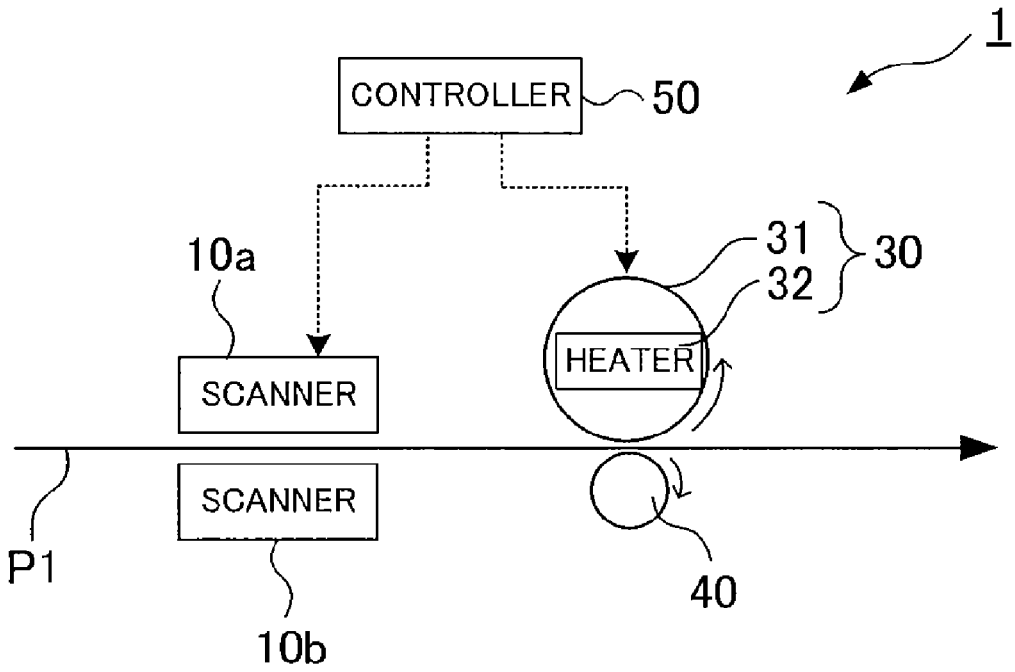
FIG. 11 is a schematic view showing the configuration of a part of an image erasing apparatus as a sixth embodiment of the invention.

An image erasing apparatus as a sixth embodiment of the invention will be described with reference to FIG. 11. In this embodiment, members having the same functions as the members described in the first and third embodiments are denoted by the same reference numerals. Hereinafter, different features from the third embodiment will be mainly described.

In this third embodiment (FIG. 5), the scanner 10 is arranged only on one side of the sheet carrying path P1. However, in this embodiment, scanners 10*a* and 10*b* are arranged on both sides of the sheet carrying path P1. The scanner 10*a* is arranged on the side of the sheet carrying path P1 where the heat roller 30 is arranged. The scanner 10*b* is arranged at a position facing the scanner 10*a* across the sheet carrying path P1.

Figure 12:
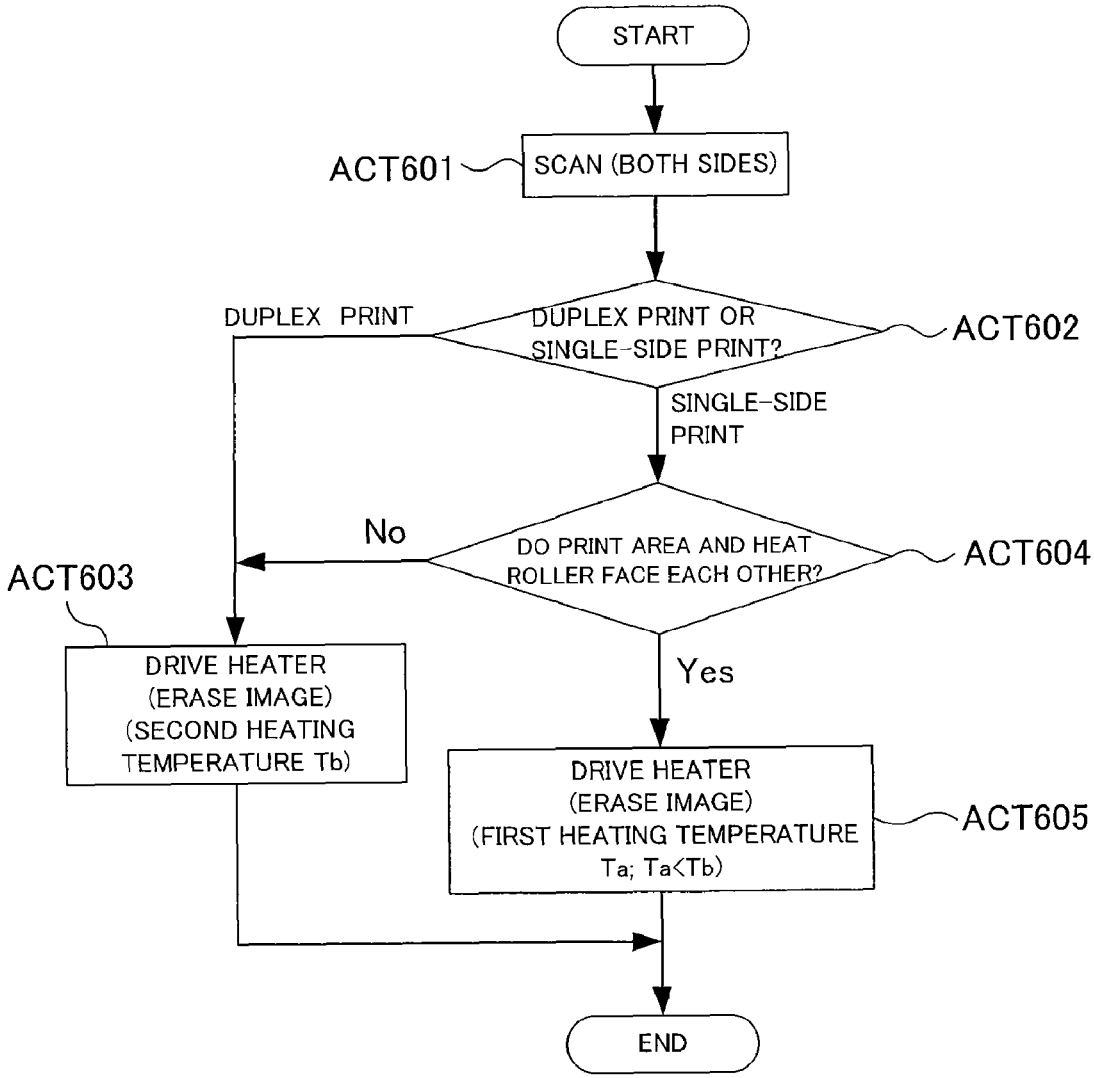
FIG. 12 is a flowchart showing the operation of the image erasing apparatus as the sixth embodiment.

Next, the operation of the image erasing apparatus 1 according to this embodiment will be described with reference to the flowchart shown in FIG. 12. The processing shown in FIG. 12 is executed by the controller 50. The processing of ACT 601 to ACT 604 shown in FIG. 12 correspond to the processing of ACT 401 to ACT 404 described with reference to FIG. 8, respectively.

If it is determined that the print area does not face the heat roller 30 in the processing of ACT 604, the controller 50 carries out the processing of ACT 603. If the print area faces the heat roller 30, the controller 50 carries out the processing of ACT 605. The processing of ACT 605 is similar to the processing of ACT 406 described with reference to FIG. 8.

In this embodiment, too, the print area (ink) can be efficiently heated and wasteful consumption of heat energy in the heating can be prevented.

In this embodiment, if it is determined that the print area does not face the heat roller 30 in the processing of ACT 604, the heating by the heat roller 30 can be carried out at a third heating temperature that is different from the first and second heating temperatures Ta and Tb. The third heating temperature is higher than the first heating temperature.

Meanwhile, as described in the first embodiment, the quantity of heat provided for the sheet can be varied in accordance with information about the sheet including print rate, sheet size, basis weight, and thickness.

Although the invention is described in detail with reference to the specific embodiments, it will be obvious to those skilled in the art that various changes and modifications can be made without departing from the spirit and scope of the invention.

What is claimed is:

1. An image erasing apparatus comprising:

a scanner which detects a side of a sheet on which an image is formed using a thermally decolorable coloring agent;

a heat roller which provides heat for the sheet having the image formed thereon; and a controller which causes a quantity of heat provided for the sheet from the heat roller when an image forming side detected by the scanner does not face the heat roller to be greater than a quantity of heat provided for the sheet from the heat roller when the image forming side faces the heat roller.

2. The apparatus according to claim 1, wherein the controller causes the heat roller to operate at a first heating temperature when the image forming side faces the heat roller, and causes the heat roller to operate at a second heating temperature that is higher than the first heating temperature when the image forming side does not face the heat roller.

3. The apparatus according to claim 1, wherein information about duplex print is printed on the sheet, and the controller causes the quantity of heat provided for the sheet from the heat roller when the information about duplex print is acquired by using the scanner to be greater than the quantity of heat provided for the sheet from the heat roller when the image is formed only on one side of the sheet, with the image forming side facing the heat roller.

4. The apparatus according to claim 3, wherein the controller acquires information about at least one of thickness and basis weight of the sheet, and increases the quantity of heat as at least one of the thickness and the basis weight increases when carrying out heating by the heat roller on the duplex-printed sheet.

5. The apparatus according to claim 1, wherein the scanner is arranged at positions on both sides across a carrying path of the sheet, and the controller determines whether the sheet is single-side-printed or duplex-printed on the basis of an output from each of the scanners, and causes the quantity of heat provided for the sheet from the heat roller when the sheet is duplex-printed to be greater than the quantity of heat provided for the sheet from the heat roller when the sheet is single-side-printed, with the image forming side facing the heat roller.

6. The apparatus according to claim 5, wherein the controller acquires information about at least one of thickness and basis weight of the sheet, and increases the quantity of heat as at least one of the thickness and the basis weight increases when carrying out heating by the heat roller on the duplex-printed sheet.

7. An image erasing method comprising:

detecting, by a scanner, a side of a sheet on which an image is formed using a thermally decolorable coloring agent; and causing a quantity of heat provided for the sheet from a heat roller when an image forming side detected by the scanner does not face the heat roller to be greater than a quantity of heat provided for the sheet from the heat roller when the image forming side faces the heat roller.

8. An image erasing apparatus comprising:

a scanner which detects a side of a sheet on which an image is formed using a thermally decolorable coloring agent;

a heat roller which provides heat for the sheet having the image formed thereon;

a reverse mechanism which reverses the sheet; and a controller which causes the sheet to move toward the heat roller and thus causes heating to be carried out when an image forming side detected by the scanner faces the heat roller, and causes the reverse mechanism to reverse the sheet and then causes heating to be carried out by the heat roller when the image forming side does not face the heat roller.

9. The apparatus according to claim 8, wherein the reverse mechanism carries the sheet passed through the scanner, upstream of the scanner on a carrying path of the sheet, and causes the sheet to move toward the scanner again.

10. The apparatus according to claim 8, wherein the reverse mechanism carries the sheet passed through the heat roller, upstream of the heat roller on a carrying path of the sheet, and causes the sheet to move toward the heat roller again.

11. The apparatus according to claim 8, wherein the controller acquires information about print rate within the image forming side by using the scanner and increases the quantity of heat provided for the sheet from the heat roller as the print rate rises.

12. The apparatus according to claim 11, wherein the controller raises at least one of a heating temperature of the heating roller and a carrying speed of the sheet by the heating roller and thus increases the quantity of heat.

13. The apparatus according to claim 8, wherein the controller acquires information about size of the sheet and increases the quantity of heat provided for the sheet from the heat roller as the size of the sheet increases.

14. The apparatus according to claim 13, wherein the controller raises at least one of a heating temperature of the heat roller and a carrying speed of the sheet by the heat roller and thus increases the quantity of heat.

15. The apparatus according to claim 8, wherein information about duplex print is printed on the sheet, and the controller causes the quantity of heat provided for the sheet from the heat roller when the information about duplex print is acquired by using the scanner to be greater than the quantity of heat provided for the sheet from the heat roller when the image is formed only on one side of the sheet.

16. The apparatus according to claim 15, wherein the controller acquires information about at least one of thickness and basis weight of the sheet, and increases the quantity of heat as at least one of the thickness and the basis weight increases when carrying out heating by the heat roller on the duplex-printed sheet.

17. The apparatus according to claim 8, wherein the scanner is arranged at positions on both sides across a carrying path of the sheet, and the controller determines whether the sheet is single-side-printed or duplex-printed on the basis of an output from each of the scanners, and causes the quantity of heat provided for the sheet from the heat roller when the sheet is duplex-printed to be greater than the quantity of heat provided for the sheet from the heat roller when the sheet is single-side-printed.

18. The apparatus according to claim 17, wherein the controller acquires information about at least one of thickness and basis weight of the sheet, and increases the quantity of heat as at least one of the thickness and the basis weight increases when carrying out heating by the heat roller on the duplex-printed sheet.

19. The apparatus according to claim 8, wherein the heat roller is a fixing roller which fixes a developer as the coloring agent to the sheet.

20. An image erasing method comprising:

detecting, by a scanner, a side of a sheet on which an image is formed using a thermally decolorable coloring agent;

when an image forming side detected by the scanner faces a heat roller, causing the sheet to move toward the heat roller and thus causing the heat roller to carry out heating; and when the image forming side does not face the heat roller, causing a reverse mechanism to reverse the sheet and then causing the heat roller to carry out heating on the reversed sheet.

* * * * *